US011577291B2

(12) United States Patent
Ehashi et al.

(10) Patent No.: US 11,577,291 B2
(45) Date of Patent: Feb. 14, 2023

(54) HOT-ROLLED STEEL SHEET FOR ELECTRICAL STEEL SHEET PRODUCTION AND METHOD OF PRODUCING SAME

(71) Applicant: JFE STEEL CORPORATION, Tokyo (JP)

(72) Inventors: Yuiko Ehashi, Tokyo (JP); Masanori Takenaka, Tokyo (JP); Takeshi Imamura, Tokyo (JP); Minoru Takashima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 128 days.

(21) Appl. No.: 16/342,015

(22) PCT Filed: Oct. 18, 2017

(86) PCT No.: PCT/JP2017/037753
§ 371 (c)(1),
(2) Date: Apr. 15, 2019

(87) PCT Pub. No.: WO2018/074531
PCT Pub. Date: Apr. 26, 2018

(65) Prior Publication Data

US 2019/0247902 A1 Aug. 15, 2019

(30) Foreign Application Priority Data

Oct. 18, 2016 (JP) ..... JP2016-204686

(51) Int. Cl.
*B21B 45/08* (2006.01)
*C21D 6/00* (2006.01)
(Continued)

(52) U.S. Cl.
CPC ..... *B21B 45/08* (2013.01); *C21D 6/004* (2013.01); *C21D 6/005* (2013.01); *C21D 6/008* (2013.01);
(Continued)

(58) Field of Classification Search
CPC ..... B21B 45/08; C21D 8/12; C22C 38/02; C22C 38/04; C22C 38/06; H01F 27/245; H01F 1/14775; H01F 1/14766
See application file for complete search history.

(56) References Cited

U.S. PATENT DOCUMENTS 3,932,234 A 1/1976 Imanaka et al.
4,898,628 A 2/1990 Block et al.
(Continued)

FOREIGN PATENT DOCUMENTS

EP 2298462 A1 3/2011
JP S38008214 B 6/1963
(Continued)

OTHER PUBLICATIONS

Nakamura et al. "The Dark Purple Hot-Rolled Steel Sheet and Manufacturing Method Thereof," (2002) (Year: 2002).*
(Continued)

*Primary Examiner* — Paul A Wartalowicz
*Assistant Examiner* — Stephani Hill
(74) *Attorney, Agent, or Firm* — Kenja IP Law PC

(57) ABSTRACT

With a hot-rolled steel sheet for electrical steel sheet production having a scale layer on the surface, where the surface of the steel sheet has a lightness L* as defined in JIS Z 8781-4: 2013 satisfying 30≤L*≤50, and chromaticities a* and b* as defined in JIS Z 8781-4: 2013 satisfying −1≤a*≤2 and −5≤b*≤3 respectively, and with one end portion in the longitudinal direction of a coil as a reference, a color difference $\Delta E_{ab}$* as defined in JIS Z 8781-4: 2013 at the
(Continued)

central portion and at the opposite end portion satisfies $\Delta E_{ab}^{*} \leq 8$, it is possible to obtain a grain-oriented electrical steel sheet where the variation of properties in a product coil is small.

6 Claims, 1 Drawing Sheet

(51) Int. Cl.

| | |
|---|---|
| ***C22C 38/40*** | (2006.01) |
| ***C22C 38/34*** | (2006.01) |
| ***C22C 38/16*** | (2006.01) |
| ***C22C 38/14*** | (2006.01) |
| ***C22C 38/12*** | (2006.01) |
| ***C22C 38/06*** | (2006.01) |
| ***C22C 38/04*** | (2006.01) |
| ***C22C 38/00*** | (2006.01) |
| ***C21D 9/46*** | (2006.01) |
| ***C21D 8/12*** | (2006.01) |
| ***C22C 38/60*** | (2006.01) |
| ***C22C 38/02*** | (2006.01) |
| ***C21D 8/00*** | (2006.01) |

(52) U.S. Cl.

CPC ..... *C21D 8/005* (2013.01); *C21D 8/12* (2013.01); *C21D 8/1222* (2013.01); *C21D 9/46* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/34* (2013.01); *C22C 38/40* (2013.01); *C22C 38/60* (2013.01)

(56) References Cited

U.S. PATENT DOCUMENTS

| | | | | |
|---|---|---|---|---|
| 4,979,997 | A | 12/1990 | Kobayashi et al. | |
| 5,114,799 | A * | 5/1992 | Ohashi | C23C 22/08 428/685 |
| 6,210,806 | B1 * | 4/2001 | Hidaka | C21D 6/002 428/472 |
| 6,309,473 | B1 | 10/2001 | Hayakawa et al. | |
| 8,409,368 | B2 * | 4/2013 | Ushigami | C21D 8/1255 148/113 |
| 2015/0155085 | A1 * | 6/2015 | Gabor | C21D 8/1205 148/111 |
| 2015/0318094 | A1 * | 11/2015 | Shingaki | C22C 38/04 148/111 |
| 2017/0240988 | A1 | 8/2017 | Imamura et al. | |

FOREIGN PATENT DOCUMENTS

| | | | | | |
|---|---|---|---|---|---|
| JP | S4015644 | B | | 7/1965 | |
| JP | S5113469 | B2 | | 4/1976 | |
| JP | S5224116 | A | | 2/1977 | |
| JP | S59193216 | A | | 11/1984 | |
| JP | H0443905 | A | | 2/1992 | |
| JP | H04301035 | A | | 10/1992 | |
| JP | H0550106 | A | | 3/1993 | |
| JP | H05279734 | A | | 10/1993 | |
| JP | 06279923 | A | * | 10/1994 | |
| JP | H07252530 | A | | 10/1995 | |
| JP | 09271806 | A | * | 10/1997 | |
| JP | 2689810 | B2 | | 12/1997 | |
| JP | 2782086 | B2 | | 7/1998 | |
| JP | 11061464 | A | * | 3/1999 | |
| JP | 2000034537 | A | * | 2/2000 | |
| JP | 2000129356 | A | | 5/2000 | |
| JP | 2000254724 | A | | 9/2000 | |
| JP | 2002327240 | A | * | 11/2002 | |
| JP | 2005193291 | A | * | 7/2005 | |
| JP | 2008095155 | A | * | 4/2008 | |
| JP | 2010196155 | A | * | 9/2010 | C21D 1/25 |
| JP | 2011068968 | A | | 4/2011 | |
| JP | 2013248629 | A | * | 12/2013 | |
| WO | 2016067636 | A1 | | 5/2016 | |

OTHER PUBLICATIONS

JP H09-271806 machine translation (Year: 1997).*
JP H11-061464 machine translation (Year: 1999).*
JP 2008-095155 machine translation (Year: 2008).*
JP 2005-193291 machine translation (Year: 2005).*
JP 2010-196155 machine translation (Year: 2010).*
JP 2013-248629 machine translation (Year: 2013).*
JP H06-279923 machine translation (Year: 1994).*
JP 2000-034537 machine translation (Year: 2000).*
JP 2002-327240 machine translation (Year: 2002).*
Jan. 23, 2018, International Search Report issued in the International Patent Application No. PCT/JP2017/037753.
Sep. 6, 2019, the Extended European Search Report issued by the European Patent Office in the corresponding European Patent Application No. 17862115.7.

* cited by examiner

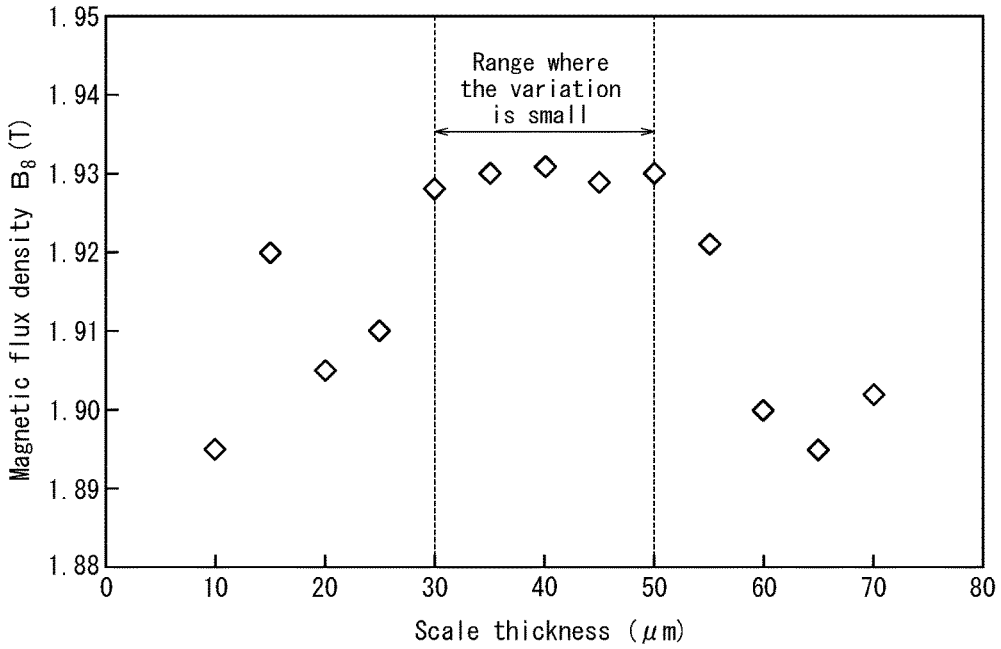
Range where
the variation
is small
Magnetic flux density $B_8$ (T)
1.95
1.94
1.93
1.92
1.91
1.90
1.89
1.88
0
10
20
30
40
50
60
70
80
Scale thickness (μm)

HOT-ROLLED STEEL SHEET FOR ELECTRICAL STEEL SHEET PRODUCTION AND METHOD OF PRODUCING SAME

TECHNICAL FIELD

This disclosure relates to a hot-rolled steel sheet (hereinafter also referred to as 'hot-rolled sheet') for electrical steel sheet production having uniform surface properties in a hot-rolled coil.

BACKGROUND

A grain-oriented electrical steel sheet is a soft magnetic material used as an iron core material of a transformer or generator, and has crystal texture in which <001> orientation which is the easy magnetization axis of iron is highly accumulated into the rolling direction of the steel sheet. Such texture is formed through secondary recrystallization of preferentially causing the growth of giant crystal grains in {110}<001> orientation which is called Goss orientation, when secondary recrystallization annealing is performed in the processes of producing the grain-oriented electrical steel sheet.

It has been a common practice for such a grain-oriented electrical steel sheet to use a technique where fine precipitates called inhibitors are used to cause secondary recrystallization of crystal grains having Goss orientation during final annealing.

For example, a method using AlN and MnS described in JP S40-015644 B (PTL 1) and a method using MnS and MnSe described in JP S51-013469 B (PTL 2) have been industrially put to use. Although these methods using inhibitors require slab heating at high temperature of 1300° C. or higher, they are very useful in stably developing secondary recrystallized grains. To strengthen the function of such inhibitors, JP S38-008214 B (PTL 3) discloses a method using Pb, Sb, Nb, and Te, and JP S52-024116 A (PTL 4) discloses a method using Zr, Ti, B, Nb, Ta, V, Cr, and Mo.

Furthermore, JP 2782086 B (PTL 5) proposes a method of suppressing the N content while containing 0.010% to 0.060% of acid-soluble Al in the slab composition, controlling slab heating to low temperature and performing nitriding in an appropriate nitriding atmosphere during decarburization annealing so that (Al, Si)N is precipitated and used as an inhibitor in secondary recrystallization. Many methods similar to the above one where nitriding treatment is performed in an intermediate process and (Al,Si)N or AlN is used as an inhibitor have been proposed and, recently, production methods such as those with slab heating temperature exceeding 1300° C. have also been disclosed.

On the other hand, JP 2000-129356 A (PTL 6) and other documents disclose a technique of preferentially causing secondary recrystallization of Goss orientation crystal grains using a raw material without inhibitor component. This method does not require fine particle distribution of inhibitors into steel, and therefore has great advantages in terms of costs and maintenance, such as not requiring slab heating at high temperature which was previously inevitable. However, it is extremely important for a chemical composition without inhibitor component to control the annealing temperature during hot band annealing. The reason is that, because of the absence of inhibitor component, the texture of the steel sheet is very dependent on temperature as compared with the case of a chemical composition with an inhibitor.

However, a slab for electrical steel sheet production contains a large amount of Si, and therefore scales called Si scales are often locally formed on the surface of the steel sheet during hot rolling. As a result, the amount of heat obtained, for example, from radiant heat varies because of the Si scales on the steel sheet surface during hot band annealing, which may cause changes in the surface properties of the hot-rolled sheet. When the surface properties of the hot-rolled sheet change, there are problems that the hot band annealing temperature varies within a coil and that feedback control promotes excessive heating or insufficient heating.

JP 2689810 B (PTL 7) proposes a method of producing a high-strengthened hot-rolled steel sheet, which is a technique of producing a hot-rolled steel sheet with 0.40 mass % to 2.0 mass % of Si and excellent surface properties. However, during the production of a hot-rolled sheet of an electrical steel sheet with 2.0 mass % or more of Si, it is still difficult to uniformize the surface properties. The problem has not been solved yet.

CITATION LIST

Patent Literature

PTL 1: JP S40-015644 B
PTL 2: JP S51-013469 B
PTL 3: JP S38-008214 B
PTL 4: JP S52-024116 A
PTL 5: JP 2782086 B
PTL 6: JP 2000-129356 A
PTL 7: JP 2689810 B

SUMMARY

Technical Problem

It could thus be helpful to provide a hot-rolled steel sheet for electrical steel sheet production where the change of surface properties (color tone) within a hot-rolled coil caused by Si scales is effectively suppressed and the variation of properties in a product coil is reduced, as well as an advantageous method of producing the hot-rolled steel sheet.

Solution to Problem

Hereinafter, reference will be made to the experiments by which the disclosure has been completed.

<Experiment>

Steel slabs containing, in mass %, C: 0.05%, Si: 3.0%, Mn: 0.1%, acid-soluble Al: 0.005%, N: 0.002% and S: 0.005%, the balance being Fe and inevitable impurities, were heated to 1270° C., subjected to first-stage hot rolling to obtain a thickness of 80 mm, and then subjected to second-stage hot rolling to obtain hot-rolled sheets with a sheet thickness of 2.5 mm. In this case, descaling with high-pressure water was performed after the first-stage hot rolling, and the scale thickness was adjusted by changing the water pressure.

Subsequently, the steel sheets with a scale thickness of 10 μm to 70 μm were subjected to hot band annealing in a continuous annealing furnace at 1050° C. for 100 seconds, and then to cold rolling once to obtain cold-rolled sheets with a final sheet thickness of 0.23 mm. Subsequently, primary recrystallization annealing which also served as decarburization was performed at 860° C. for 100 seconds in a wet atmosphere of 55 vol % $H_2$-45 vol % $N_2$. Subsequently, an annealing separator mainly composed of MgO was applied to the surface of each steel sheet. After the annealing separator was dried, final annealing which included purification and secondary recrystallization was performed at 1200° C. for 5 hours in a hydrogen atmosphere.

Ten test pieces with a width of 100 mm were taken respectively from the two end portions and the central portion in the longitudinal direction of a coil of each grain-oriented electrical steel sheet thus obtained, and the magnetic flux density $B_8$ of each test piece was measured with the method described in JIS C 2556.

FIG. 1 illustrates the results of examining the transition of the average value of magnetic flux density $B_8$, with the scale thickness after hot rolling as the horizontal axis.

As illustrated in FIG. 1, it was found that the magnetic flux density $B_8$ is uniform and good when the scale thickness after hot rolling is in a range of 30 μm to 50 μm.

Additionally, Table 1 lists the measuring results of the lightness L* and chromaticities a* and b* as defined in JIS Z 8729 of the surface scale after hot rolling.

As indicated in Table 1, when the magnetic flux density is in a range where its variation is small, the lightness L* is $30 \leq L^* \leq 50$, the chromaticity a* is $-1 \leq a^* \leq 2$, the chromaticity b* is $-5 \leq b^* \leq 3$, and the color difference $\Delta E_{ab}^*$ based on a scale thickness of 40 μm is within a range of $\Delta E_{ab}^* \leq 8$. It was determined that the color of the surface scale influences the variation of magnetic flux density $B_8$.

TABLE 1

| Scale thickness after hot rolling (μm) | Lightness L* | Chromaticity a* | Chromaticity b* | Color difference $\Delta E_{ab}^*$ | Magnetic flux density $B_8$ (T) |
|---|---|---|---|---|---|
| 10 | 70 | −0.5 | 6 | 31.8 | 1.895 |
| 15 | 66 | −0.5 | 4.5 | 27.6 | 1.920 |
| 20 | 63 | −0.3 | 3.9 | 24.5 | 1.905 |
| 25 | 51 | −0.1 | 3.5 | 12.9 | 1.910 |
| 30 | 46 | −0.06 | 2.5 | 7.9 | 1.928 |
| 35 | 43 | 0.5 | 0.9 | 4.5 | 1.930 |
| 40 | 39 | 1.1 | −1 | 0.0 | 1.931 |
| 45 | 34 | 1.5 | −2.5 | 5.2 | 1.929 |
| 50 | 32 | 1.8 | −4.3 | 7.8 | 1.930 |
| 55 | 30 | 2.5 | −5.1 | 10.0 | 1.921 |
| 60 | 29 | 2.7 | −5.5 | 11.1 | 1.900 |
| 65 | 30 | 2.9 | −5.8 | 10.4 | 1.895 |
| 70 | 30 | 3.2 | −5.8 | 10.4 | 1.902 |

It is still unclear why the reduction in color difference of the surface scale of the hot-rolled sheet suppresses the variation of magnetic flux density $B_8$ in a product sheet. However, our consideration is as follows.

That is, the color of the surface scale of a hot-rolled sheet influences the amount of radiant heat obtained by the steel sheet during hot band annealing. Therefore, when a steel sheet with different surface colors was annealed in a continuous furnace under the same conditions, the obtained amount of heat was locally different. As a result, the soaking temperature was locally different, leading to the variation of magnetic flux density $B_8$ in a product sheet. Accordingly, we considered that, by controlling the scale thickness during hot rolling as in the aforementioned case and keeping the color of the surface scale of the hot-rolled sheet uniform, it would possible to control the temperature precisely during hot band annealing, thereby obtaining a magnetic flux density $B_8$ with small variation in a product sheet.

This disclosure is based on the aforementioned discoveries and further studies.

We thus provide the following.

1. A hot-rolled steel sheet for electrical steel sheet production, comprising a scale layer on a surface, where the surface of the steel sheet has a lightness L* as defined in JIS Z 8781-4: 2013 satisfying $30 \leq L^* \leq 50$, and chromaticities a* and b* as defined in JIS Z 8781-4: 2013 within ranges of $-1 \leq a^* \leq 2$ and $-5 \leq b^* \leq 3$ respectively, wherein with one end portion in the longitudinal direction of a hot-rolled coil as a reference, a color difference $\Delta E_{ab}^*$ as defined in JIS Z 8781-4: 2013 at a central portion and at the opposite end portion of the coil satisfies $\Delta E_{ab}^* 8$ respectively.

2. The hot-rolled steel sheet for electrical steel sheet production according to 1., comprising a chemical composition containing (consisting of), in mass %, C: 0.02% to 0.08%, Si: 2.0% to 5.0%, Mn: 0.02% to 1.0%, acid-soluble Al: 0.01% or less, and S: 0.0015% to 0.01%, wherein N is suppressed to less than 0.006%, and the balance is Fe and inevitable impurities.

3. The hot-rolled steel sheet for electrical steel sheet production according to 2., further comprising, in mass %, at least one selected from Ni: 1.5% or less, Cu: 1.0% or less, Cr: 0.5% or less, P: 0.5% or less, Sb: 0.5% or less, Sn: 0.5% or less, Bi: 0.5% or less, Mo: 1.0% or less, Ti: 0.05% or less, Nb: 0.1% or less, V: 0.1% or less, B: 0.0025% or less, Te: 0.01% or less, or Ta: 0.01% or less.

4. A method of producing the hot-rolled steel sheet for electrical steel sheet production according to any one of 1. to 3., wherein during hot rolling after slab heating in a range of 1180° C. or higher and 1300° C. or lower, a delivery temperature of first-stage rolling where rolling is performed until obtaining a thickness of 100 mm or less is 950° C. or higher, and descaling with high-pressure water is performed prior to subsequent second-stage rolling where rolling is performed until obtaining a thickness of 3.0 mm or less, wherein for scales on a surface of a steel sheet after the second-stage rolling, with one end portion in the longitudinal direction of a hot-rolled coil as a reference, a difference in the thickness of surface scale at a central portion and at the opposite end portion of the coil is suppressed to less than 25 μm respectively.

5. The method of producing a hot-rolled steel sheet for electrical steel sheet production according to 4., wherein after the slab heating, primary scales are destroyed by a scale breaker prior to first-stage hot rolling.

Advantageous Effect

According to this disclosure, it is possible to obtain a hot-rolled steel sheet for electrical steel sheet production where the non-uniformity of temperature in the longitudinal direction during hot band annealing is reduced by controlling the color of the surface scale of the hot-rolled sheet, thereby obtaining a grain-oriented electrical steel sheet where the variation of magnetic flux density $B_8$ in a product coil is small.

BRIEF DESCRIPTION OF THE DRAWINGS

In the accompanying drawings:

FIG. 1 illustrates the relationship between the scale thickness on the surface of a hot-rolled sheet after hot rolling and the magnetic flux density $B_8$ of a product sheet.

DETAILED DESCRIPTION

The following describes the present disclosure in detail.

First, a suitable chemical composition of the steel raw material (slab) of the present disclosure will be described. The '%' associated with the chemical composition represents 'mass %' unless specified otherwise.

C: 0.02% to 0.08%

When the C content is less than 0.02%, no a-y phase transformation occurs, and carbide itself decreases, rendering it difficult to exhibit the effects of carbide control. On the other hand, when the C content exceeds 0.08%, it is difficult to reduce the C content by decarburization annealing to an amount of 0.005% or less at which no magnetic aging occurs. Therefore, the C content is preferably in a range of 0.02% to 0.08%. The C content is more preferably in a range of 0.02% to 0.05%.

Si: 2.0% to 5.0%

Si is an element necessary for increasing the specific resistance of the steel and reducing iron loss. The above effects are insufficient when the Si content is less than 2.0%. On the other hand, when the Si content exceeds 5.0%, the workability deteriorates, rendering it difficult to produce a product by rolling. Therefore, the Si content is preferably in a range of 2.0% to 5.0%. The Si content is more preferably in the range of 2.5% to 4.5%.

Mn: 0.02% to 1.0% Mn is an element necessary for improving the hot workability of the steel. The above effect is insufficient when the Mn content is less than 0.02%. On the other hand, when the Mn content exceeds 1.0%, the magnetic flux density of a product sheet decreases. Therefore, the Mn content is preferably in a range of 0.02% to 1.0%. The Mn content is more preferably in a range of 0.05% to 0.7%.

Acid-Soluble Al: 0.01% or Less

Al may form a dense oxide film on the surface and inhibit decarburization. Therefore, Al is preferably suppressed to 0.01% or less by the amount of acid-soluble Al. It is desirably 0.008% or less.

S: 0.0015% to 0.01%

S forms MnS and $Cu_2S$, and suppresses grain growth as solute S or Se at the same time, which contributes to the stabilization of magnetic properties. When the S content is less than 0.0015%, the amount of solute S is insufficient and the magnetic properties are unstable. On the other hand, when the S content exceeds 0.01%, the dissolution of precipitate during slab heating before hot rolling is insufficient and the magnetic properties are unstable. Therefore, the S content is preferably in a range of 0.0015% to 0.01%. Furthermore, S has an effect of enhancing the descaling properties, and is desirably in a range of 0.002% to 0.01%.

N: less than 0.006%

N may cause defects such as blisters during slab heating. Therefore, the N content is preferably suppressed to less than 0.006%.

In addition to the aforementioned components, the present disclosure may also include at least one selected from Ni: 1.5% or less, Cu: 1.0% or less, Cr: 0.5% or less, P: 0.5% or less, Sb: 0.5% or less, Sn: 0.5% or less, Bi: 0.5 or less, Mo: 1.0% or less, Ti: 0.05% or less, Nb: 0.1% or less, V: 0.1% or less, B: 0.0025% or less, Te: 0.01% or less or Ta: 0.01% or less, to improve the magnetic properties.

With respect to these components, Ni: 0.5% or less, Cu: 0.8% or less, Cr: 0.15% or less, P: 0.15% or less, Sb: 0.15% or less, Sn: 0.15% or less, Bi: 0.2% or less, Mo: 0.1% or less, Ti: 0.01% or less, Nb: 0.05% or less, V: 0.05% or less, B: 0.0020% or less, Te: 0.005% or less or Ta: 0.005% or less is particularly preferable.

Next, a method of producing the hot-rolled steel sheet of the present disclosure will be described.

Molten steel having the aforementioned chemical composition is obtained by steelmaking using a conventional refining process, and then made into a steel raw material (slab) by conventionally known ingot casting and blooming or continuous casting. Alternatively, the molten steel may be made into a thin slab or thinner cast steel with a thickness of 100 mm or less by direct casting.

The slab is heated to a temperature of 1180° C. or higher and 1300° C. or lower with a conventional method and then subjected to hot rolling. The slab may be directly subjected to hot rolling without heating if its temperature is not lower than the temperature range after casting.

It is required to divide the hot rolling into two stages and perform descaling between the two stages. It is essential to perform the descaling with high-pressure water to adjust the scale thickness after hot rolling so that the difference of the scale thickness in the longitudinal direction is suppressed to less than 25 μm. In this case, the descaling can easily lead to uniform surface properties if the delivery temperature of the first-stage rolling is 950° C. or higher. The exact reason is still unclear. However, one possible explanation is that the presence of S, which has been added to the steel, in the surface scale improves the exfoliation properties. In the case of making a thin slab or thinner cast steel with a thickness of 100 mm or less, hot rolling is performed in one stage and descaling is performed before the hot rolling.

In a case where the scale thickness is simply adjusted by the descaling with high-pressure water after the first-stage hot rolling, the temperature of the steel sheet decreases excessively, which may be disadvantageous in terms of texture control.

In such a case, it is effective to destroy primary scales on the slab surface by a scale breaker before the first-stage hot rolling. In this way, the descaling after the first-stage hot rolling can be easily performed, and newly formed scales can be easily exfoliated.

A hot-rolled steel sheet for electrical steel sheet production can thus be obtained.

The subsequent processes of producing a grain-oriented electrical steel sheet are as follows.

The hot-rolled sheet obtained by hot rolling is subjected to hot band annealing. In order to obtain good magnetic properties, the annealing temperature of the hot band annealing is preferably in a range of 1000° C. to 1150° C. in a case where cold rolling is performed for one time, and in a range of 800° C. to 1200° C. in a case where cold rolling is performed for two times. When the hot band annealing temperature is lower than 800° C., band texture formed during the hot rolling remains. As a result, it is difficult to obtain primary recrystallized texture of uniformly-sized grains, and the development of secondary recrystallization is hindered. In the case where cold rolling is performed for one time, the hot band annealing is annealing performed immediately before the final cold rolling, so that the temperature is desirably 1000° C. or higher. On the other hand, when the hot band annealing temperature exceeds 1200° C., crystal grains coarsen excessively after the hot band annealing. As a result, it is also difficult to obtain primary recrystallized texture of uniformly-sized grains. Therefore, the temperature is desirably 1200° C. or lower. Particularly in the case where cold rolling is performed for one time, the hot band annealing is annealing performed immediately before the final cold rolling, so that the temperature is desirably 1100° C. or lower. The holding time in this temperature range is required to be 10 seconds or longer in order to uniformize the texture after the hot band annealing. However, long-time holding does not contribute to magnetic property improvement, so that the holding time is desirably no longer than 300 seconds from the perspective of operating costs.

In a case where the hot band annealing is performed in a continuous annealing furnace, the temperature can be controlled precisely not only for one coil but also for a plurality of coils by connecting hot-rolled sheets with a close color tone and close sheet thickness together.

After the hot band annealing, the sheet is subjected to cold rolling once, or twice or more with intermediate annealing performed therebetween, to obtain a cold-rolled sheet with a final sheet thickness. The annealing temperature of the intermediate annealing is preferably in a range of 900° C. to 1200° C. When the temperature is lower than 900° C., recrystallized grains become finer after the intermediate annealing, and Goss nuclei in primary recrystallized texture tend to decrease and the magnetic properties of a product sheet tend to deteriorate. On the other hand, when the temperature exceeds 1200° C., crystal grains coarsen excessively as in the case of the hot band annealing, rendering it difficult to obtain primary recrystallized texture of uniformly-sized grains. In particular, the intermediate annealing before the final cold rolling is desirably in a temperature range of 1000° C. to 1150° C., and the holding time is required to be 10 seconds or longer in order to uniformize the texture after the hot band annealing. However, long-time holding does not contribute to magnetic property improvement, so that the holding time is desirably no longer than 300 seconds from the perspective of operating costs.

Furthermore, in order to sufficiently develop <111>//ND orientation in the texture of a primary recrystallization annealed sheet, the cold rolling (final cold rolling) in which a final sheet thickness is obtained is preferably performed with a rolling reduction of 80% to 95%.

The cold-rolled sheet with the final sheet thickness is then subjected to primary recrystallization annealing. The primary recrystallization annealing may also serve as decarburization annealing. From the perspective of decarburization properties, the annealing temperature is preferably in a range of 800° C. to 900° C., and the atmosphere is preferably a wet atmosphere. Furthermore, by rapidly increasing the temperature at a rate of 30° C./s or more in a temperature range of 500° C. to 700° C. during the temperature rising process of the primary recrystallization annealing, recrystallization nuclei of Goss orientation grains can be increased and iron loss can be lowered, and a grain-oriented electrical steel sheet having both high magnetic flux density and low iron loss can be produced. However, when the heating rate exceeds 400° C./s, randomized texture is formed, and the magnetic properties are deteriorated. Therefore, the heating rate is preferably 30° C./s or more and 400° C./s or less. The heating rate is desirably 50° C./s or more and 300° C./s or less.

After performing the primary recrystallization annealing to the steel sheet, an annealing separator mainly composed of MgO is applied on the surface of the steel sheet and dried. Subsequently, the steel sheet is subjected to final annealing to develop secondary recrystallized texture highly accumulated in Goss orientation and to form a forsterite film. In order to develop secondary recrystallization, the annealing temperature of the final annealing is preferably 800° C. or higher. Additionally, in order to complete the secondary recrystallization, the annealing temperature is preferably kept at 800° C. or higher for 20 hours or longer. Furthermore, in order to form a good forsterite film, it is preferable to raise the temperature to about 1200° C. and keep the temperature for one hour or longer.

It is effective for reducing iron loss to subject the steel sheet after the final annealing to, for example, water washing, brushing, or pickling to remove unreacted annealing separator adhered to the surface of the steel sheet, and then subject the steel sheet to flattening annealing for shape adjustment. This is because final annealing is generally performed with the sheet in a coil state, so that the coil tends to wind after the final annealing, which may deteriorate the properties in an iron loss measurement. Furthermore, in a case where the steel sheets are laminated and used, it is effective to form an insulating coating on the surface of the steel sheet before or after the flattening annealing. In particular, it is preferable to use a tension-applying coating capable of applying tension to the steel sheet as the insulating coating in order to reduce iron loss. When the tension-applying coating is formed by applying a tension coating via a binder, or by depositing inorganic materials on the surface of the steel sheet with a physical vapor deposition method or chemical vapor deposition method, it is possible to form an insulating coating with excellent coating adhesion properties and a considerable iron loss reduction effect.

Furthermore, it is possible to subject the steel sheet to magnetic domain refining treatment so that iron loss can be further reduced. The magnetic domain refining treating method may be a generally used method, such as a method of grooving the steel sheet after final annealing, a method of introducing thermal strain or impact strain in a linear or dot-sequence manner by, for example, electron beam irradiation, laser irradiation or plasma irradiation, or a method of performing etching on the surface of an intermediate steel sheet, such as a steel sheet with a final sheet thickness after the cold rolling, to form grooves.

Example S

Example 1

A plurality of steel slabs containing C: 0.06%, Si: 2.8%, Mn: 0.08%, acid-soluble Al: 0.005%, N: 0.004% and S: 0.01%, the balance being Fe and inevitable impurities, were prepared. The steel slabs were heated to 1230° C., and then subjected to hot rolling to obtain hot-rolled sheets with a sheet thickness of 2.2 mm. The conditions of the hot rolling are listed in Table 2. The scale thickness was adjusted by descaling with high-pressure water before second-stage hot rolling. Subsequently, the sheets were subjected to hot band annealing at 1000° C. for 100 seconds, and then to cold rolling twice with intermediate annealing at 1060° C. performed for 100 seconds therebetween, to obtain cold-rolled sheets with a final sheet thickness of 0.23 mm. Subsequently, primary recrystallization annealing which also served as decarburization annealing was performed at 850° C. for 100 seconds in a wet atmosphere of 55 vol % $H_2$-45 vol % $N_2$. Subsequently, an annealing separator mainly composed of MgO was applied to the surface of each steel sheet. After the annealing separator was dried, final annealing which included purification and secondary recrystallization was performed at 1200° C. for 5 hours in a hydrogen atmosphere.

Ten test pieces with a width of 100 mm were taken respectively from the two end portions and the central portion of a coil of each grain-oriented electrical steel sheet thus obtained. The magnetic flux density $B_8$ of each test piece was measured with the method described in JIS C 2556, and the average value was determined.

The obtained results are listed in Table 2.

Additionally, Table 2 also lists the measuring results of the lightness L*, chromaticities a* and b*, and color difference $\Delta E_{ab}$* as defined in JIS Z 8781-4:2013 of the hot-rolled steel sheets.

TABLE 2

| | First-stage hot rolling | Inside end portion of the coil after hot rolling | | | | | Central portion of the coil after hot rolling | | | |
|---|---|---|---|---|---|---|---|---|---|---|
| No. | Delivery temperature (° C) | Scale thickness (μm) Note 1 | Lightness L* | Chromaticity a* | Chromaticity b* | Magnetic flux density $B_8$ (T) Note 2 | Scale thickness (μm) Note 1 | Lightness L* | Chromaticity a* | Chromaticity b* |
| 1 | 1050 | 30 | 48 | 0.0 | 0.1 | 1.931 | 30 | 48 | 0.0 | −0.2 |
| 2 | 1050 | 30 | 48 | 0.0 | 0.1 | 1.928 | 40 | 43 | 0.3 | −0.2 |
| 3 | 1050 | 30 | 48 | 0.0 | 0.1 | 1.932 | 50 | 40 | 1.2 | −0.2 |
| 4 | 1000 | 30 | 47 | −0.1 | −3.0 | 1.928 | 30 | 48 | −0.1 | −2.9 |
| 5 | 1000 | 30 | 48 | −0.1 | −2.8 | 1.926 | 40 | 43 | 0.2 | −2.7 |
| 6 | 1000 | 30 | 48 | −0.2 | −2.8 | 1.928 | 50 | 40 | 1.5 | −2.7 |
| 7 | 950 | 50 | 42 | 1.5 | −4.8 | 1.929 | 50 | 40 | 1.5 | −4.7 |
| 8 | 950 | 50 | 42 | 1.4 | −4.8 | 1.929 | 60 | 38 | 1.8 | −4.7 |
| 9 | 950 | 50 | 42 | 1.4 | −4.5 | 1.925 | 70 | 37 | 1.8 | −4.4 |
| 10 | 900 | 50 | 41 | 2.6 | 3.5 | 1.898 | 50 | 40 | 2.6 | 3.6 |
| 11 | 900 | 50 | 41 | 2.6 | 3.5 | 1.902 | 60 | 37 | 2.8 | 3.6 |
| 12 | 900 | 50 | 42 | 2.6 | 3.8 | 1.889 | 70 | 37 | 3.0 | 3.9 |
| 13 | 1050 | 50 | 42 | 0.5 | −0.1 | 1.927 | 50 | 40 | 1.5 | 0.0 |
| 14 | 1050 | 50 | 42 | 0.5 | −0.1 | 1.928 | 30 | 48 | −0.2 | 0.0 |
| 15 | 1050 | 50 | 43 | 0.5 | −0.1 | 1.932 | 40 | 43 | 0.3 | 0.0 |
| 16 | 1100 | 70 | 39 | 0.3 | 2.1 | 1.928 | 70 | 38 | 0.5 | −0.1 |
| 17 | 1100 | 70 | 40 | 0.3 | 2.1 | 1.928 | 80 | 31 | 1.9 | −0.1 |

| | Central portion of the coil after hot rolling | | Outside end portion of the coil after hot rolling | | | | | | |
|---|---|---|---|---|---|---|---|---|---|
| No. | Color difference $\Delta E_{ab}$* | Magnetic flux density $B_8$ (T) Note 2 | Scale thickness (μm) Note1 | Lightness L* | Chromaticity a* | Chromaticity b* | Color difference $\Delta E_{ab}$* | Magnetic flux density $B_8$ (T) Note 2 | Remarks |
| 1 | 0 | 1.930 | 30 | 48 | 0.0 | 0.1 | 0 | 1.931 | Example |
| 2 | 5 | 1.930 | 50 | 40 | 0.0 | 0.1 | 8 | 1.929 | Example |
| 3 | 8 | 1.928 | 70 | 38 | 0.0 | 0.1 | 10 | 1.915 | Comparative example |
| 4 | 1 | 1.928 | 30 | 48 | −0.1 | −3.0 | 1 | 1.930 | Example |
| 5 | 5 | 1.925 | 50 | 40 | −0.1 | −2.8 | 8 | 1.927 | Example |
| 6 | 8 | 1.925 | 70 | 38 | −0.2 | −2.8 | 10 | 1.918 | Comparative example |
| 7 | 2 | 1.930 | 50 | 40 | 1.5 | −4.8 | 2 | 1.931 | Example |
| 8 | 4 | 1.928 | 70 | 36 | 1.4 | −4.8 | 6 | 1.928 | Example |
| 9 | 5 | 1.925 | 90 | 35 | 1.4 | −4.5 | 7 | 1.905 | Comparative example |
| 10 | 1 | 1.885 | 50 | 40 | 2.6 | 3.5 | 1 | 1.881 | Comparative example |
| 11 | 4 | 1.893 | 70 | 36 | 2.6 | 3.5 | 5 | 1.889 | Comparative example |
| 12 | 5 | 1.882 | 90 | 35 | 2.6 | 3.8 | 7 | 1.880 | Comparative example |
| 13 | 2 | 1.926 | 50 | 40 | 1.5 | −0.1 | 2 | 1.926 | Example |
| 14 | 6 | 1.930 | 10 | 68 | 1.5 | −0.1 | 26 | 1.901 | Comparative example |
| 15 | 0 | 1.929 | 30 | 48 | 1.5 | −0.1 | 5 | 1.931 | Example |
| 16 | 2 | 1.930 | 70 | 38 | 0.5 | −0.3 | 3 | 1.928 | Example |
| 17 | 9 | 1.915 | 90 | 30 | 2.5 | −0.5 | 11 | 1.905 | Comparative example |

Note 1 scale thickness after hot rolling

Note 2 magnetic flux density $B_8$ after final annealing

According to Table 2, it can be understood that when the color tone (lightness, chromaticity) and color difference of the hot-rolled sheet satisfy the ranges of the present disclosure, the variation of magnetic properties in a product sheet is small.

Example 2

Steel slabs having the chemical composition as listed in Table 3 were heated to 1300° C. and subjected to hot rolling, which was divided into two stages, to obtain hot-rolled sheets with a sheet thickness of 2.2 mm. The delivery temperature of the first-stage rolling of the hot rolling was 1050° C. Additionally, a VSB (vertical scale breaker) was used after the slab heating, and descaling with high-pressure water was performed after the first-stage rolling. In this way, the scale thickness of each hot-rolled sheet was adjusted to a range of 30 μm to 50 μm. Subsequently, the sheets were subjected to hot band annealing at 1030° C. for 100 seconds, and then to cold rolling once to obtain cold-rolled sheets with a final sheet thickness of 0.23 mm. Subsequently, primary recrystallization annealing which also served as decarburization annealing was performed at 870° C. for 100 seconds in a wet atmosphere of 55 vol % $H_2$-45 vol % $N_2$. For those with a chemical composition with an additional amount of nitrogen as listed in the ΔN column of Table 3, nitriding was performed in $NH_3$-atmosphere gas after the primary recrystallization annealing. Subsequently, an annealing separator mainly composed of MgO was applied to the surface of each steel sheet. After the annealing separator was dried, final annealing which included purification and secondary recrystallization was performed at 1200° C. for 5 hours in a hydrogen atmosphere.

Ten test pieces with a width of 100 mm were taken respectively from the two end portions and the central portion of a coil of each grain-oriented electrical steel sheet thus obtained. The magnetic flux density $B_8$ of each test piece was measured with the method described in JIS C 2556, and the average value was determined.

The obtained results, as well as the measuring results of the lightness L*, chromaticities a* and b*, and color difference $\Delta E_{ab}$* of the hot-rolled steel sheets, are listed in Table 4.

TABLE 3

| No. | C | Si | Mn | Al | N | ΔN | S | Others | Remarks |
|---|---|---|---|---|---|---|---|---|---|
| | (mass %) | | | | | | | | |
| 18 | 0.01 | 3.0 | 0.31 | 0.005 | 0.003 | — | 0.005 | — | Comparative material |
| 19 | 0.09 | 3.0 | 0.30 | 0.005 | 0.003 | — | 0.005 | — | Comparative material |
| 20 | 0.05 | 1.8 | 0.30 | 0.005 | 0.003 | — | 0.005 | — | Comparative material |
| 21 | 0.05 | 5.2 | 0.31 | 0.005 | 0.003 | — | 0.005 | — | Comparative material |
| 22 | 0.05 | 3.0 | 0.01 | 0.005 | 0.003 | — | 0.005 | — | Comparative material |
| 23 | 0.05 | 3.0 | 1.2 | 0.005 | 0.003 | — | 0.005 | — | Comparative material |
| 24 | 0.05 | 3.0 | 0.30 | 0.005 | 0.011 | — | 0.005 | — | Comparative material |
| 25 | 0.05 | 3.0 | 0.32 | 0.005 | 0.004 | — | 0.001 | — | Comparative material |
| 26 | 0.05 | 3.0 | 0.31 | 0.005 | 0.004 | — | 0.012 | — | Comparative material |
| 27 | 0.05 | 3.0 | 0.30 | 0.005 | 0.004 | — | 0.005 | — | Example |
| 28 | 0.05 | 2.0 | 0.30 | 0.005 | 0.004 | — | 0.005 | Sn 0.3, Ni 1.0 | Example |
| 29 | 0.05 | 5.0 | 0.30 | 0.005 | 0.004 | — | 0.005 | Sb 0.3, Cu 0.8 | Example |
| 30 | 0.02 | 3.5 | 0.30 | 0.005 | 0.004 | — | 0.005 | Cr 0.1, P 0.1 | Example |
| 31 | 0.08 | 3.5 | 0.31 | 0.006 | 0.004 | — | 0.005 | Mo 0.5, Ti 0.03 | Example |
| 32 | 0.04 | 3.5 | 0.02 | 0.006 | 0.004 | — | 0.005 | Nb 0.08, B 0.002 | Example |
| 33 | 0.04 | 3.5 | 0.10 | 0.007 | 0.004 | — | 0.005 | V 0.08, Bi 0.1, Ta 0.005 | Example |
| 34 | 0.04 | 3.5 | 0.05 | 0.009 | 0.004 | — | 0.005 | Te 0.005, B 0.002, Cu 0.08 | Example |
| 35 | 0.04 | 3.5 | 0.05 | 0.003 | 0.005 | — | 0.005 | Ni 0.05, Bi 0.01, Cr 0.05 | Example |
| 36 | 0.03 | 3.5 | 0.05 | 0.003 | 0.005 | — | 0.009 | Mo 0.08, V 0.05, Sn 0.05 | Example |
| 37 | 0.03 | 3.5 | 0.80 | 0.003 | 0.003 | — | 0.003 | Sb 0.01, Nb 0.01, P 0.01 | Example |
| 38 | 0.03 | 3.5 | 0.80 | 0.004 | 0.003 | — | 0.003 | Cu 0.08, P 0.05, Sn 0.05 | Example |
| 39 | 0.05 | 3.0 | 0.30 | 0.005 | 0.003 | 0.020 | 0.005 | — | Example |
| 40 | 0.05 | 3.5 | 0.30 | 0.005 | 0.003 | 0.035 | 0.005 | Sn 0.3, Ni 1.0 | Example |
| 41 | 0.05 | 3.5 | 0.30 | 0.005 | 0.003 | 0.035 | 0.005 | Sb 0.3, Cu 0.8 | Example |
| 42 | 0.03 | 3.5 | 0.30 | 0.005 | 0.003 | 0.030 | 0.005 | Cr 0.1, P 0.1 | Example |
| 43 | 0.03 | 3.5 | 0.31 | 0.006 | 0.004 | 0.020 | 0.005 | Mo 0.4, Ti 0.02 | Example |
| 44 | 0.04 | 3.5 | 0.30 | 0.006 | 0.003 | 0.020 | 0.005 | Nb 0.08, B 0.0015 | Example |

TABLE 4

| | Inside end portion of the coil after hot rolling | | | | Central portion of the coil after hot rolling | | | | |
|---|---|---|---|---|---|---|---|---|---|
| No. | Lightness L* | Chromaticity a* | Chromaticity b* | Magnetic flux density $B_8$ (T) Note 2 | Lightness L* | Chromaticity a* | Chromaticity b* | Color difference $\Delta E_{ab}$* | Magnetic flux density $B_8$ (T) Note 2 |
| 18 | 40 | 0.2 | −2.4 | 1.875 | 41 | 0.3 | −2.3 | 1 | 1.873 |
| 19 | 41 | 0.3 | −2.5 | 1.867 | 41 | 0.3 | −2.3 | 0 | 1.871 |
| 20 | 40 | 0.2 | −2.4 | 1.887 | 40 | 0.3 | −2.1 | 0 | 1.883 |
| 21 | 41 | 0.3 | −2.5 | 1.863 | 41 | 0.3 | −2.5 | 0 | 1.855 |
| 22 | 41 | 0.3 | −2.5 | 1.885 | 41 | 0.3 | −2.0 | 1 | 1.879 |
| 23 | 42 | 0.3 | −3.0 | 1.869 | 43 | 0.4 | −3.1 | 1 | 1.853 |
| 24 | 40 | 0.3 | −2.8 | 1.854 | 40 | 0.3 | −2.6 | 0 | 1.857 |
| 25 | 40 | 0.3 | −2.8 | 1.901 | 41 | 0.3 | −2.1 | 1 | 1.887 |
| 26 | 40 | 0.2 | −2.6 | 1.865 | 41 | 0.3 | −2.7 | 1 | 1.872 |
| 27 | 42 | 0.3 | −1.9 | 1.927 | 40 | 0.3 | −1.4 | 2 | 1.926 |
| 28 | 40 | 0.3 | −1.8 | 1.928 | 40 | 0.3 | −1.7 | 0 | 1.929 |
| 29 | 43 | 0.4 | −1.8 | 1.931 | 40 | 0.2 | −1.6 | 3 | 1.931 |
| 30 | 40 | 0.2 | −1.7 | 1.930 | 42 | 0.3 | −1.5 | 2 | 1.928 |
| 31 | 40 | 0.3 | −2.0 | 1.927 | 39 | 0.2 | −2.1 | 1 | 1.926 |
| 32 | 41 | 0.3 | −2.5 | 1.932 | 41 | 0.3 | −2.0 | 1 | 1.930 |
| 33 | 42 | 0.3 | −2.5 | 1.929 | 42 | 0.3 | −2.4 | 0 | 1.927 |
| 34 | 42 | 0.3 | −3.0 | 1.933 | 40 | 0.3 | −3.2 | 2 | 1.932 |
| 35 | 42 | 0.3 | −3.2 | 1.928 | 40 | 0.3 | −2.9 | 2 | 1.925 |
| 36 | 42 | 0.3 | −3.2 | 1.930 | 42 | 0.3 | −3.2 | 0 | 1.931 |
| 37 | 41 | 0.3 | −3.0 | 1.930 | 41 | 0.2 | −2.5 | 1 | 1.928 |
| 38 | 40 | 0.2 | −3.0 | 1.928 | 41 | 0.2 | −2.9 | 1 | 1.928 |
| 39 | 40 | 0.2 | −2.7 | 1.933 | 40 | 0.2 | −2.5 | 0 | 1.935 |
| 40 | 42 | 0.3 | −3.0 | 1.932 | 42 | 0.3 | −3.1 | 0 | 1.933 |
| 41 | 42 | 0.3 | −3.0 | 1.931 | 42 | 0.4 | −3.0 | 0 | 1.932 |
| 42 | 40 | 0.3 | −2.5 | 1.930 | 40 | 0.3 | −2.0 | 1 | 1.929 |

TABLE 4-continued

| | | | | | | | | | |
|---|---|---|---|---|---|---|---|---|---|
| 43 | 40 | 0.3 | −2.5 | 1.932 | 40 | 0.3 | −2.4 | 0 | 1.934 |
| 44 | 40 | 0.3 | −2.0 | 1.930 | 40 | 0.2 | −2.3 | 0 | 1.934 |

| | Outside end portion of the coil after hot rolling | | | | | |
|---|---|---|---|---|---|---|
| No. | Lightness L* | Chromaticity a* | Chromaticity b* | Color difference $\Delta E_{ab}$* | Magnetic flux density $B_8$ (T) Note 2 | Remarks |
| 18 | 41 | 0.2 | −2.1 | 1 | 1.881 | Comparative material |
| 19 | 42 | 0.3 | −2.0 | 1 | 1.869 | Comparative material |
| 20 | 41 | 0.3 | −2.0 | 1 | 1.879 | Comparative material |
| 21 | 43 | 0.3 | −2.8 | 2 | 1.857 | Comparative material |
| 22 | 41 | 0.2 | −1.9 | 1 | 1.883 | Comparative material |
| 23 | 44 | 0.4 | −3.4 | 2 | 1.876 | Comparative material |
| 24 | 39 | 0.2 | −1.9 | 1 | 1.859 | Comparative material |
| 25 | 39 | 0.2 | −2.0 | 1 | 1.885 | Comparative material |
| 26 | 41 | 0.3 | −2.9 | 1 | 1.876 | Comparative material |
| 27 | 40 | 0.3 | −1.2 | 2 | 1.923 | Example |
| 28 | 41 | 0.3 | −1.4 | 1 | 1.930 | Example |
| 29 | 39 | 0.2 | −1.5 | 4 | 1.929 | Example |
| 30 | 41 | 0.3 | −1.8 | 1 | 1.928 | Example |
| 31 | 39 | 0.2 | −1.9 | 1 | 1.926 | Example |
| 32 | 41 | 0.3 | −2.3 | 0 | 1.927 | Example |
| 33 | 42 | 0.4 | −1.7 | 1 | 1.930 | Example |
| 34 | 41 | 0.3 | −3.7 | 1 | 1.931 | Example |
| 35 | 41 | 0.4 | −2.7 | 1 | 1.929 | Example |
| 36 | 40 | 0.2 | −3.4 | 2 | 1.929 | Example |
| 37 | 39 | 0.3 | −2.2 | 2 | 1.930 | Example |
| 38 | 40 | 0.2 | −2.8 | 0 | 1.930 | Example |
| 39 | 40 | 0.2 | −2.2 | 1 | 1.933 | Example |
| 40 | 42 | 0.3 | −3.2 | 0 | 1.934 | Example |
| 41 | 41 | 0.3 | −2.3 | 1 | 1.931 | Example |
| 42 | 41 | 0.4 | −1.3 | 2 | 1.931 | Example |
| 43 | 41 | 0.3 | −2.9 | 1 | 1.933 | Example |
| 44 | 41 | 0.3 | −2.1 | 1 | 1.930 | Example |

*Note 2* magnetic flux density $B_8$ after final annealing

According to Table 4, it can be understood when hot rolling is performed with the suitable chemical composition and under the suitable hot rolling conditions of the present disclosure and the color tone and color difference of the hot rolled sheet satisfy the appropriate ranges of the present disclosure, the variation of magnetic properties in a product sheet is small.

The invention claimed is:

1. A hot-rolled steel sheet for electrical steel sheet production, comprising a chemical composition containing, in mass %, C: 0.02% to 0.08%, Si: 2.5% to 5.0%, Mn: 0.02% to 1.0%, acid-soluble Al: 0.01% or less, and S: 0.0015% to 0.01%, wherein N is suppressed to less than 0.006%, and the balance is Fe and inevitable impurities, and a scale layer on a surface, where the surface of the scale layer of the steel sheet has a lightness L* as defined in JIS Z 8781-4: 2013 satisfying $30 \leq L^* \leq 50$, and chromaticities a* and b* as defined in JIS Z 8781-4: 2013 within ranges of $-1 \leq a^* \leq 2$ and $-5 \leq b^* \leq 3$ respectively, wherein with one end portion in the longitudinal direction of a hot-rolled coil as a reference, a color difference $\Delta E_{ab}$* as defined in JIS Z 8781-4: 2013 at a central portion and at the opposite end portion of the coil satisfies $\Delta E_{ab}^* \leq 8$ respectively, and a thickness of the scale layer is in a range of 30 μm to 50 μm.

2. The hot-rolled steel sheet for electrical steel sheet production according to claim 1, further comprising, in mass %, at least one selected from Ni: 1.5% or less, Cu: 1.0% or less, Cr: 0.5% or less, P: 0.5% or less, Sb: 0.5% or less, Sn: 0.5% or less, Bi: 0.5% or less, Mo: 1.0% or less, Ti: 0.05% or less, Nb: 0.1% or less, V: 0.1% or less, B: 0.0025% or less, Te: 0.01% or less, or Ta: 0.01% or less.

3. A method of producing the hot-rolled steel sheet for electrical steel sheet production according to claim 1, comprising heating a slab to a temperature of 1180° C. or higher and 1300° C. or lower, and subjecting the slab to hot rolling to obtain a steel sheet, the hot rolling comprising first-stage rolling and subsequent second-stage rolling, wherein the first-stage rolling is performed until a thickness of the steel sheet of 100 mm or less is obtained, a delivery temperature of the first-stage rolling, which is a temperature of the steel sheet delivered from the first-stage rolling, is 950° C. or higher, the second-stage rolling is performed until a thickness of the steel sheet of 3.0 mm or less is obtained, after the first-stage rolling and prior to the second-stage rolling, descaling with high-pressure water is performed, and for scales on a surface of the steel sheet after the second-stage rolling, with one end portion in the longitudinal direction of a hot-rolled coil as a reference, a difference in thickness between a surface scale at the reference and a surface scale at a central portion of the coil is suppressed to less than 25 μm, and a difference in thickness between the surface scale at the reference and a surface scale at an opposite end portion of the coil is suppressed to less than 25 μm.

4. The method of producing a hot-rolled steel sheet for electrical steel sheet production according to claim 3, wherein after the heating and prior to the first-stage rolling, primary scales are destroyed by a scale breaker.

5. A method of producing the hot-rolled steel sheet for electrical steel sheet production according to claim 2, comprising heating a slab to a temperature of 1180° C. or higher and 1300° C. or lower, and subjecting the slab to hot rolling to obtain a steel sheet, the hot rolling comprising first-stage rolling and subsequent second-stage rolling, wherein the first-stage rolling is performed until a thickness of the steel sheet of 100 μm or less is obtained, a delivery temperature of the first-stage rolling, which is a temperature of the steel sheet delivered from the first-stage rolling, is 950° C. or higher, the second-stage rolling is performed until a thickness of the steel sheet of 3.0 mm or less is obtained, after the first-stage rolling and prior to the second-stage rolling, descaling with high-pressure water is performed, and for scales on a surface of the steel sheet after the second-stage rolling, with one end portion in the longitudinal direction of a hot-rolled coil as a reference, a difference in thickness between a surface scale at the reference and a surface scale at a central portion of the coil is suppressed to less than 25 μm, and a difference in thickness between the surface scale at the reference and a surface scale at an opposite end portion of the coil is suppressed to less than 25 μm.

6. The method of producing a hot-rolled steel sheet for electrical steel sheet production according to claim 5, wherein after the heating and prior to the first-stage rolling, primary scales are destroyed by a scale breaker.

* * * * *